US005386839A

United States Patent [19]

Chen

[11] Patent Number: 5,386,839

[45] Date of Patent: Feb. 7, 1995

[54] COMB

[76] Inventor: Hong Y. Chen, P.O. Box 82-144, Taipei, Taiwan, Prov. of China

[21] Appl. No.: 996,563

[22] Filed: Dec. 24, 1992

[51] Int. Cl.[6] ..... A45D 24/38

[52] U.S. Cl. ..... 132/152; 132/159; 132/160

[58] Field of Search ..... 132/107, 120, 121, 122, 132/123, 152, 153, 154, 158, 159, 160, 219

[56] References Cited

U.S. PATENT DOCUMENTS

| | | | |
|---|---|---|---|
| 1,486,688 | 3/1924 | Roscher | 132/159 |
| 2,238,603 | 4/1941 | Runnels | 132/120 |
| 2,506,297 | 5/1950 | Goodman | 132/159 |
| 2,551,131 | 5/1951 | Iesersek | 132/154 |
| 2,763,895 | 9/1956 | Iesersek | 132/159 |
| 4,057,867 | 11/1977 | Ballin | 132/219 |
| 4,292,986 | 10/1981 | Ergaver et al. | 132/219 |
| 4,368,376 | 1/1983 | Andis | 132/150 |

FOREIGN PATENT DOCUMENTS

| | | | |
|---|---|---|---|
| 713252 | 8/1931 | France | 132/152 |
| 844191 | 7/1939 | France | 132/152 |
| 803367 | 4/1951 | Germany | 132/152 |
| 2649565 | 5/1978 | Germany | 132/219 |
| 267815 | 7/1950 | Switzerland | 132/152 |
| 20157 | of 1912 | United Kingdom | 132/152 |

*Primary Examiner*—Cary E. O'Connor

*Attorney, Agent, or Firm*—Bucknam and Archer

[57] ABSTRACT

This invention relates to an improved comb and in particular to one including a left member having a plurality of holes on the inner side thereof and an elongated projection on the outer side thereof, a right member having a plurality of protuberances on the inner side thereof adapted to engage with the holes of the left member and an elongated projection on the outer side thereof, and a plurality of line members connected between the left member and the right member and being each provided with a cut at an intermediate portion, whereby when the left member is joined with the right member with the holes of the left member engaged with the protuberances of the right member, the line members will be bent at the cuts to form a plurality of elliptical loops for tidying hair.

2 Claims, 11 Drawing Sheets

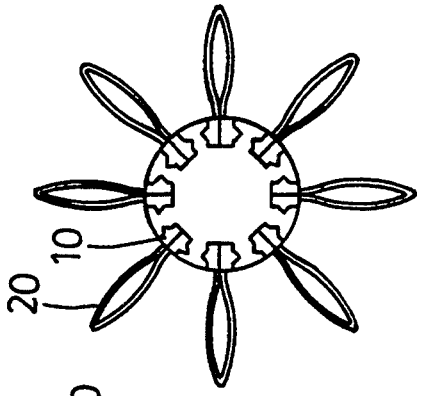
FIG. 10B
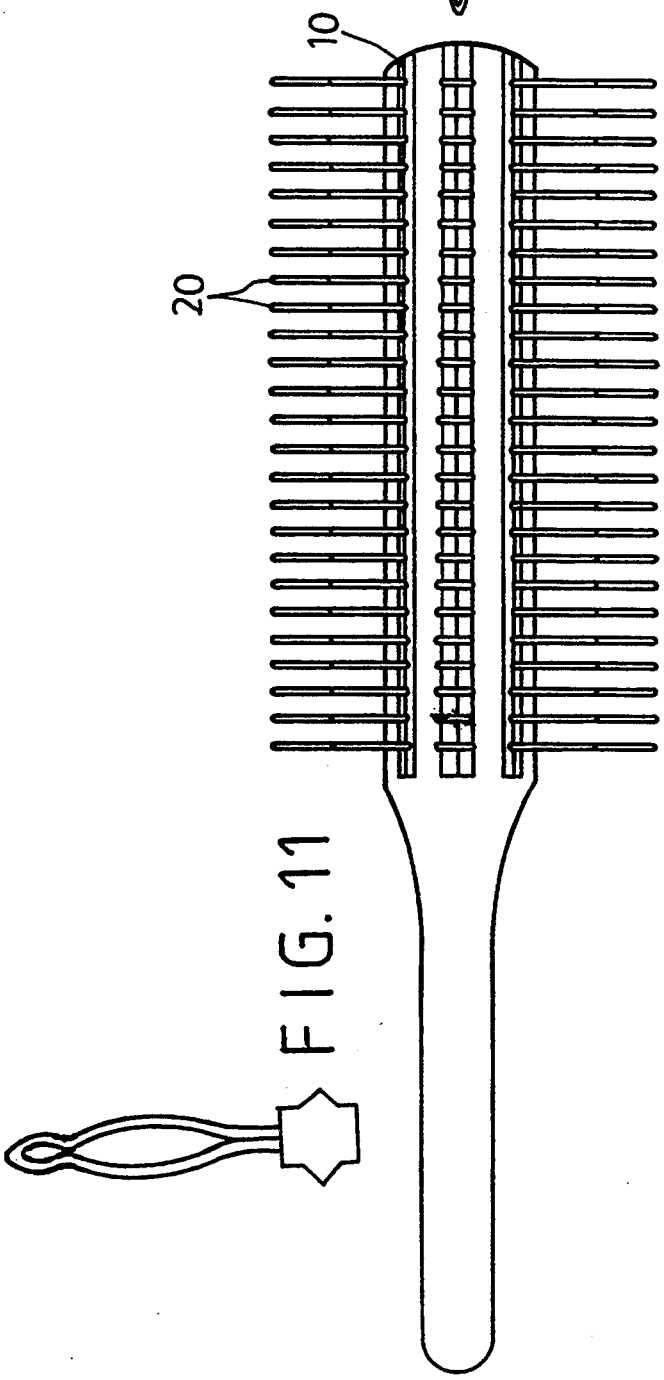
FIG. 10A
FIG. 11

COMB

BACKGROUND OF THE INVENTION

It is found that the prior art combs are unsatisfactory in use and have the following drawbacks:

1. The teeth are too hard and may hurt the scalp in use.
2. Such combs may pull the hair in use.
3. The tips of such combs are made of chemical substance which is toxic and may cause harmful side effects to the user.

SUMMARY OF THE INVENTION

Therefore, it is an object of the present invention to provide a comb which may obviate and mitigate the above-mentioned drawbacks.

This invention relates to an improved comb.

It is the primary object of the present invention to provide a comb which may prevent the scalp from being hurt in use.

It is another object of the present invention to provide a comb which will not pull the hair.

It is still another object of the present invention to provide a comb which is easy to manufacture.

It is still another object of the present invention to provide a comb which is low in cost.

It is a further object of the present invention to provide a comb which is fit for mass production.

Other objects and merits and a fuller understanding to the present invention will be obtained by those having ordinary skill in the art when the following detailed description of the preferred embodiment is read in conjunction with the accompanying drawings.

BRIEF DESCRIPTION OF THE DRAWINGS

FIG. 10A shows an eighth preferred embodiment; and

FIG. 10B is a side view of FIG. 10A.

FIG. 11 shows another preferred embodiment of the line member of the present invention.

DETAILED DESCRIPTION OF THE PREFERRED EMBODIMENT

Figure 1:
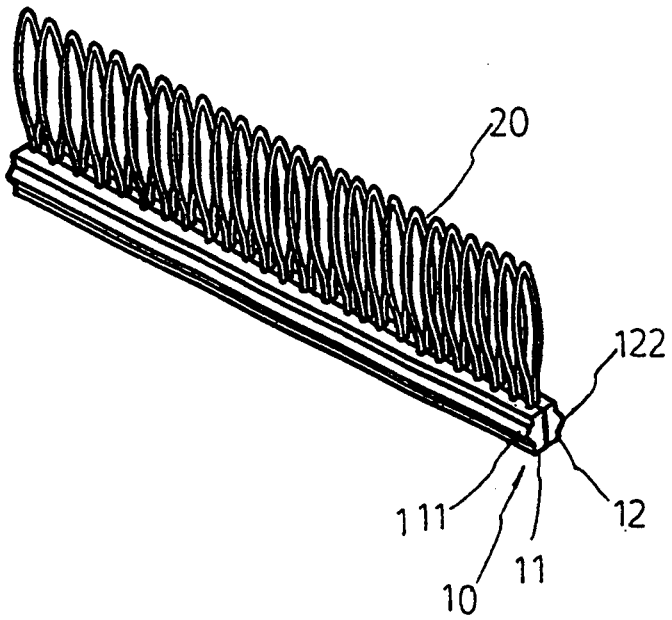
FIG. 1 is a perspective view of the present invention.

For purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
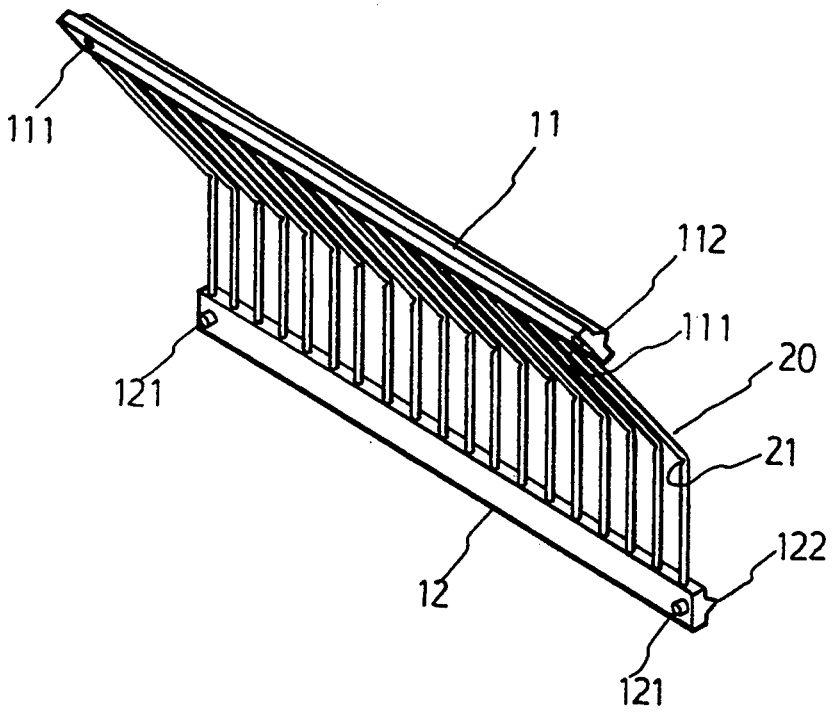
FIG. 2 is a developed view of the present invention.

With reference to the drawing and in particular to FIGS. 1 and 2 thereof, the comb according to the present invention mainly comprises a spine 10 and a plurality of teeth 20. The spine 10 is composed of a left member 11 and a right member 12 which are engaged together. The inner side of the left member 11 is formed with two holes 111 while the outer side of the left member 11 has an elongated projection 112. The inner side of the right member 11 is provided with two protuberances 121 adapted to engage with the two holes 111 of the left member 11, while the outer side of the right member 12 has an elongated projection 122. The elongated projection 112 has the same shape and size as the elongated projection 122. The tooth 20 is made of a line member of which one end is fixedly connected with the left member 11 and the other fixedly connected with the right member 12. Further, the center of the line member is provided with a cut 21 so that when the left member 11 and the right member 12 are joined together, the line member will be bent at the cut 21 thereby forming an elliptical loop.

Figure 3:
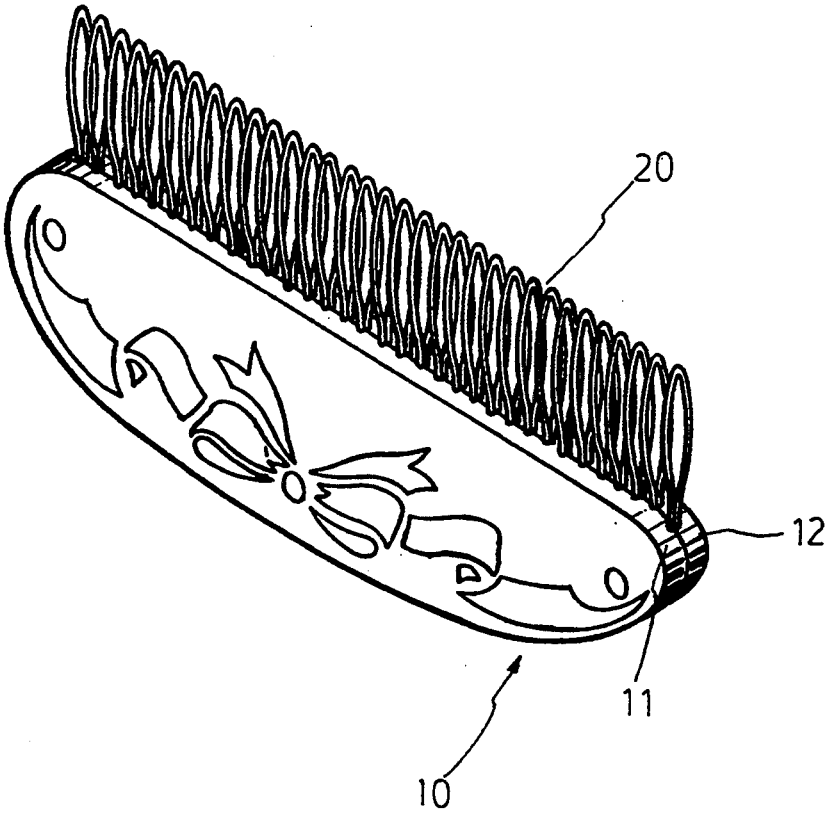
FIG. 3 is a perspective view of a second preferred embodiment of the present invention.
Figure 4:
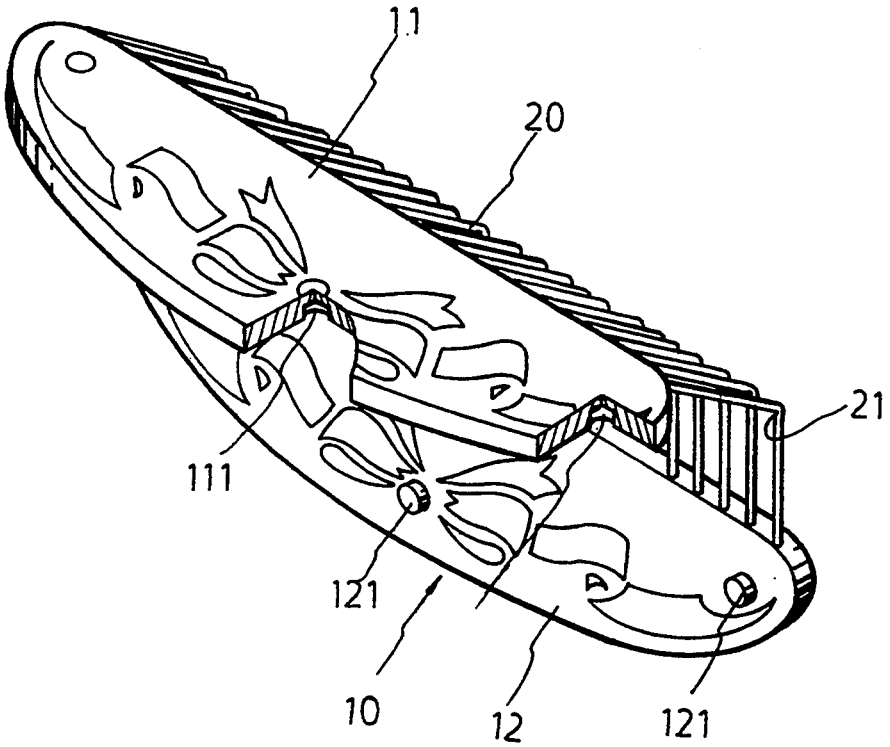
FIG. 4 is a developed view of the second preferred embodiment.

FIGS. 3 and 4 show another preferred embodiment of the present invention, wherein the left member 11 and the right member 12 are enlarged in area and provided with patterns on their outer sides thereof.

Figure 5:
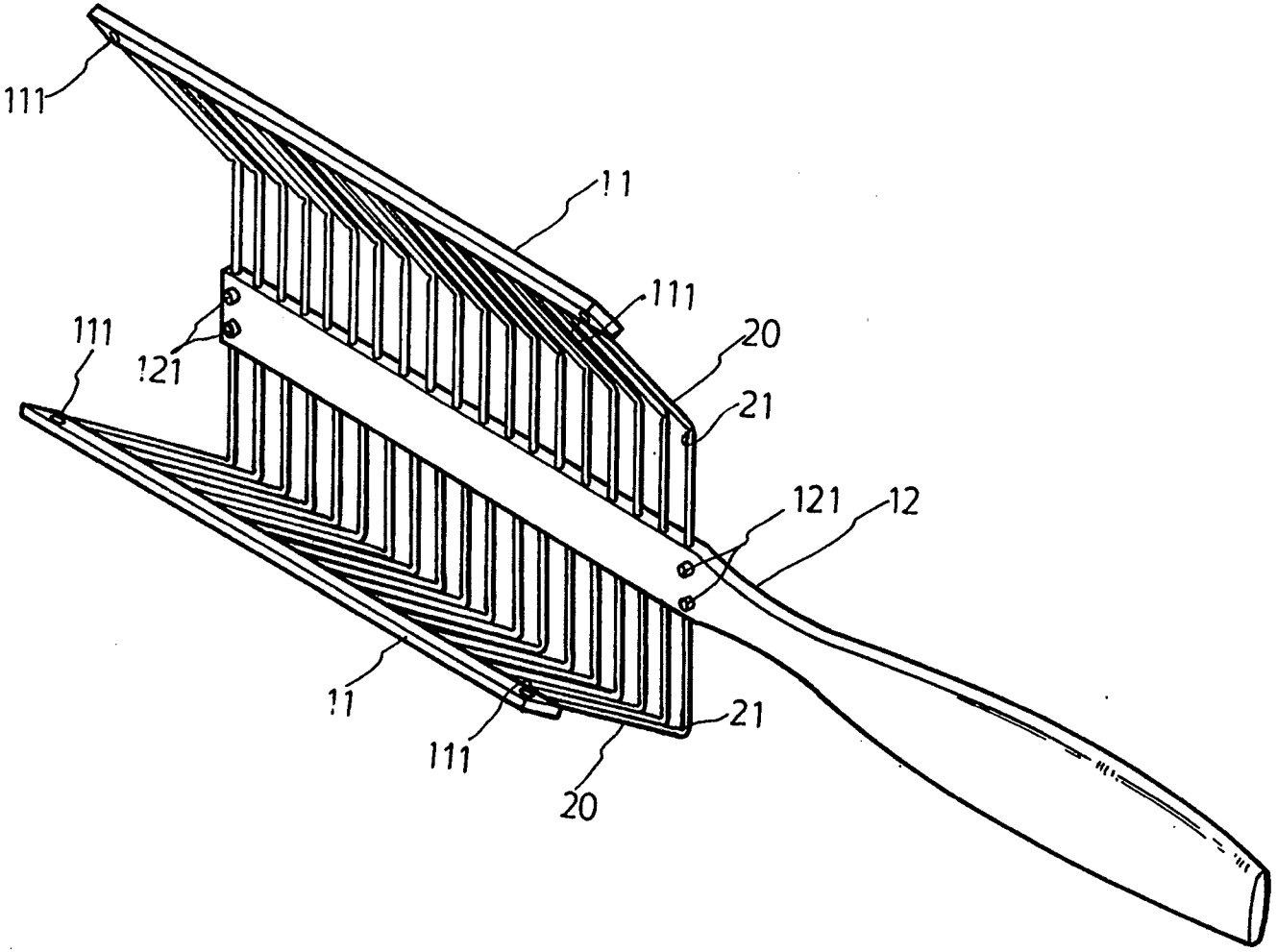
FIG. 5A shows a third preferred embodiment.
FIG. 5B is a side view of FIG. 5A.

FIG. 5 shows a third preferred embodiment of the present invention, wherein the right member 12 is provided with two protuberances 121 at both ends and a plurality of line members 20 at both sides which are connected with a left member 11 at the other end. Each left member 11 is provided with a hole 111 at both ends for engaging with corresponding protuberance 121 of the right member 12. As the left member 11 and the right member 12 are joined together, the line members will form a plurality of elliptical loops for tidying the hair.

Figure 5B:
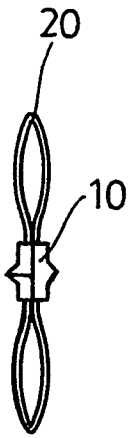
Figure 5A:
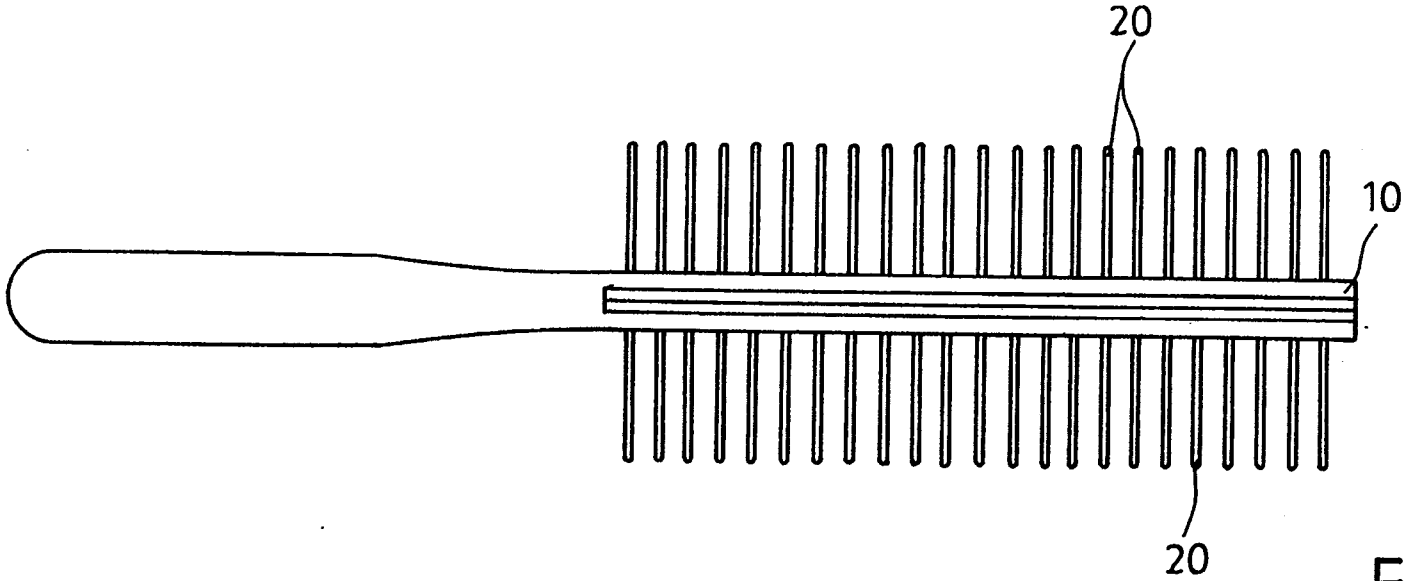

FIG. 5A shows the front view of the third preferred embodiment, while FIG. 5B the end view of the third preferred embodiment.

Figure 6A:
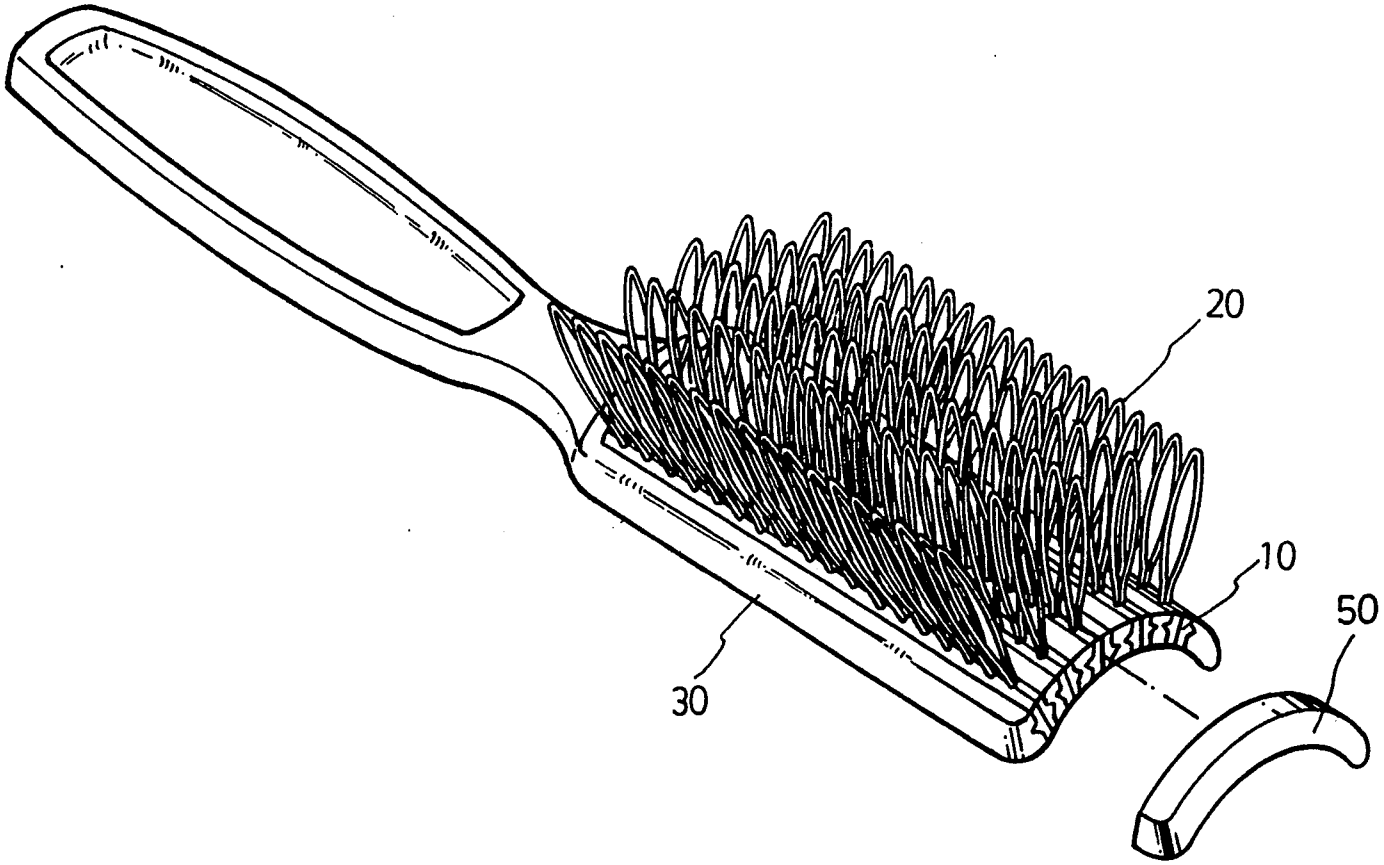
FIG. 6A shows a fourth preferred embodiment.
Figure 6B:
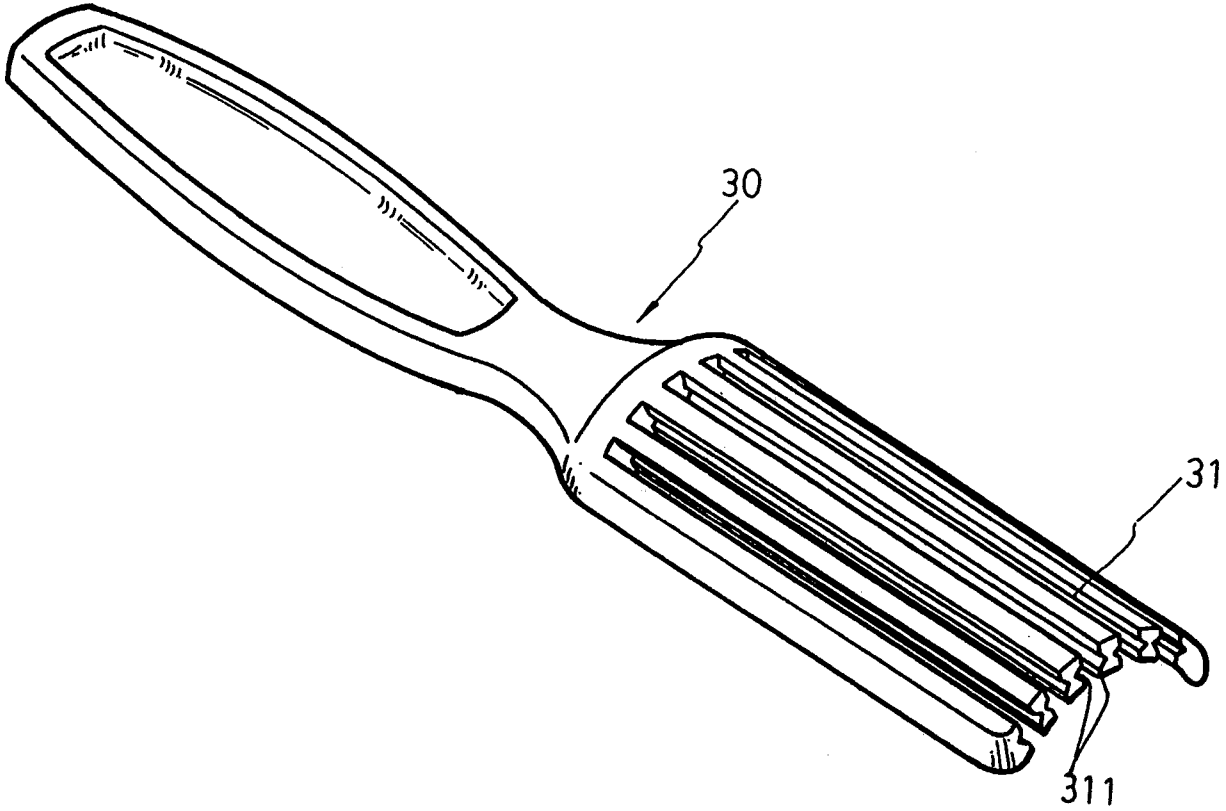
FIG. 6B is a perspective view of the brush frame of the fourth preferred embodiment.

FIGS. 6A and 6B show a fourth preferred embodiment of the present invention, wherein a plurality of the combs are inserted into a brush frame which is provided with a plurality of elongated members 31 spaced apart and having a slot 311 at both sides thereof. Hence, the comb may be inserted between the elongated members 31 with the elongated projection 112 and 122 of the spine 10 of the comb engaged with the slots 311 of the elongated members of the brush frame.

Figure 7B:
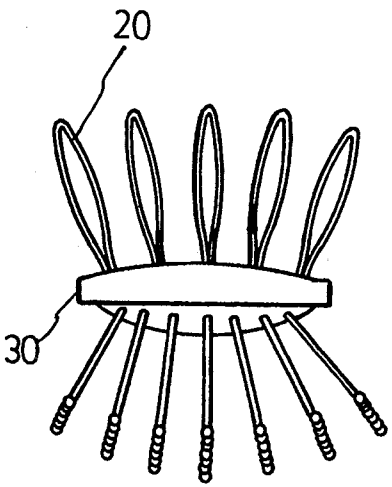
FIG. 7B is a side view of FIG. 7A.
Figure 7A:
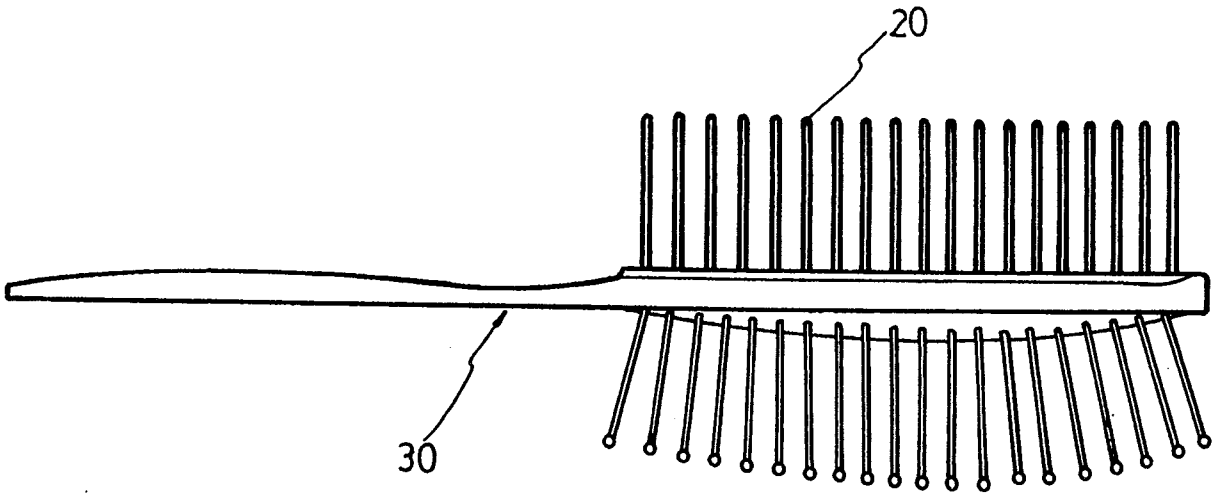
FIG. 7A shows a fifth preferred embodiment.

FIGS. 7 and 7A show a fifth preferred embodiment of the present invention, wherein the other side of the brush is provided with a plurality of straight teeth so as to increase the use thereof.

Figure 8:
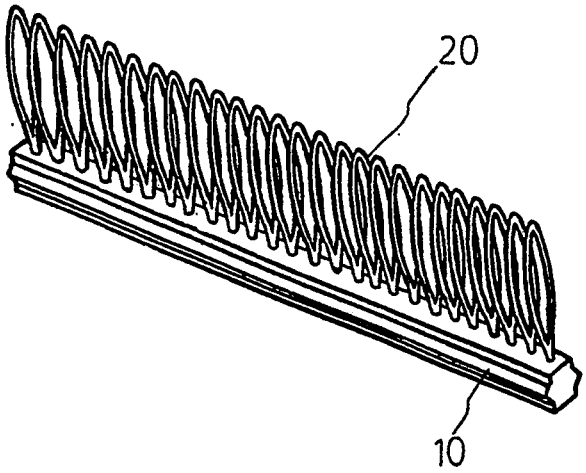
FIG. 8 shows a sixth preferred embodiment.

FIG. 8 shows a sixth preferred embodiment of the present invention, wherein the spine 10 may be conveniently integrally formed into an one-piece member.

Figure 9A:
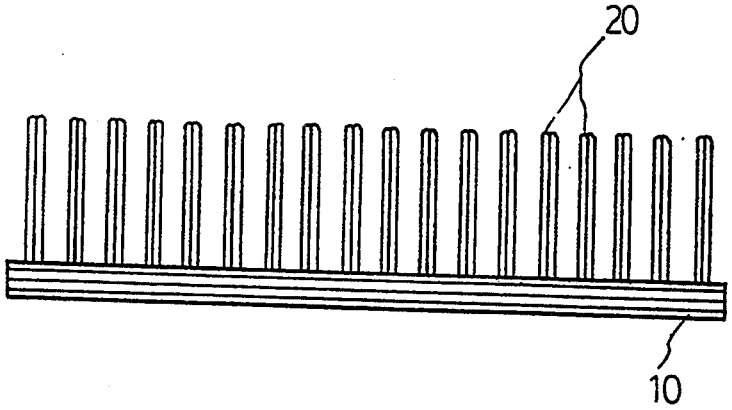
FIG. 9A shows a seventh preferred embodiment.
Figure 9B:
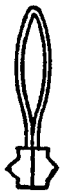
FIG. 9B is a side view of FIG. 9A.

FIGS. 9 and 9A show a seventh preferred embodiment of the present invention, wherein two line members are joined together to meet the practical need.

FIGS. 10A and 10B show an eighth preferred embodiment of the present invention, wherein a plurality of teeth are provided on a rounded brush frame.

FIG. 11 shows another preferred embodiment of the present invention wherein the upper port of the line member is joined together by high frequency heating.

The application of the present invention is too wide to be mentioned and cannot be all enumerated here in detail. It is understood that the present disclosure is made by way of example only and that numerous changes in the detail of construction and the combination of parts may be resorted to without departing from the spirit and scope of the invention as hereinafter claimed.

I claim:

1. A comb comprising, in combination:

a) at least one comb element;

said at least one comb element having an initial flat configuration and having a left member and a right member engagable with each other;

said left member having a plurality of holes along an inner side of its length and an elongated projection on an outer side thereof;

said right member having a plurality of protuberances on an inner side of its length, said protuberances being spaced at locations to engage with said holes of said left member when said left and right members are engaged with each other, said plurality of holes and said plurality of protuberances forming retaining elements for retaining the left and right members in a mated relationship, said right member having an elongated projection on an outer side of an identical shape and size as said elongated projection of said left member;

a plurality of line members connecting said left member and said right member, each line member having a cut at an intermediate portion to allow said line member to bend about said cut, said line members forming a plurality of elliptical loops when said left and right members are engaged; and b ) a comb frame;

said comb frame having an open end at one end and a handle portion at the other end, said comb frame having at least one groove formed therein, said at least one groove being sized and shaped to match and slidably receive said at least one comb element and engage said elongated projections of said at least one comb element when said left and right members are engaged;

whereby said at least one comb element is formed by engaging said left and right members and is slidably inserted into said at least one groove in said comb frame to form a completed comb assembly.

2. The comb as claimed in claim 1, wherein said comb frame further comprises a plurality of said grooves receiving a plurality of said comb elements to form a brush profile.

* * * * *